US005563633A

United States Patent [19]

Parsons

[11] Patent Number: 5,563,633

[45] Date of Patent: Oct. 8, 1996

[54] METHOD AND APPARATUS FOR DATA COMPRESSION DURING MONITOR REFRESH OPERATIONS

[75] Inventor: Donald H. Parsons, Liberty, S.C.

[73] Assignee: AT&T Global Information Solutions Company, Dayton, Ohio

[21] Appl. No.: 175,945

[22] Filed: Dec. 30, 1993

[51] Int. Cl.[6] ..... G09G 5/00

[52] U.S. Cl. ..... 345/202; 345/185; 382/232

[58] Field of Search ..... 345/202, 185, 345/189, 201; 382/232, 233; 358/261.1, 261.2, 261.3, 261.4

[56] References Cited

U.S. PATENT DOCUMENTS

| | | | |
|---|---|---|---|
| 4,125,873 | 11/1978 | Chesarek | 345/202 |
| 4,574,364 | 3/1986 | Tabata et al. . | |
| 4,799,677 | 1/1989 | Frederiksen | 345/202 |
| 4,876,607 | 10/1989 | Tseng | 345/202 |
| 5,081,450 | 1/1992 | Lucas et al. | 382/232 |
| 5,184,124 | 2/1993 | Molpus et al. | 358/261.4 |

FOREIGN PATENT DOCUMENTS 0522697 1/1993 European Pat. Off. .

OTHER PUBLICATIONS

J. Staudhammer et al., *High Performance Display System for Dynamic Image Generation*, The Second International Conference on Computers and Applications, Jun. 23, 1987; Beijing, China; pp. 336–343, XP 000092434.

Richard A. Quinnell (Technical Editor), *Image Compression Part 1*, EDN, Jan. 21, 1993, pp. 62–71.

Richard A. Quinnell (Technical Editor), *Image Compression Part 2*, EDN, Mar. 4, 1993, pp. 120–126.

*Primary Examiner*—Richard Hjerpe
*Assistant Examiner*—Regina Liang
*Attorney, Agent, or Firm*—George H. Gates

[57] ABSTRACT

The present invention discloses a method and apparatus for performing data compression during monitor refresh operations. In one embodiment, it is envisioned that the compression functions would be performed in a refresh compaction device and the de-compression functions would be performed in a RAMDAC, thereby requiring only the transfer of compressed data between the refresh compaction device and the RAMDAC. In an alternative embodiment, it is envisioned that both the compression and de-compression functions would be performed in the refresh compaction device. Regardless of implementation, a "critical fill" level is determined during compression and a "critical fill" interrupt is generated during de-compression to gain control of the frame buffer before the compressed digital data is fully depleted.

15 Claims, 4 Drawing Sheets

METHOD AND APPARATUS FOR DATA COMPRESSION DURING MONITOR REFRESH OPERATIONS

BACKGROUND OF THE INVENTION

1. Field of the Invention

This invention relates in general to computer input/output (I/O) device interfaces, and in particular to a method for data compression during refresh operations for computer displays.

2. Description of Related Art

The use of computers to display high resolution color images and video is well known in the art. The volume of data required to display high resolution color images and video has led to the development of data compression and coding techniques, including the JPEG, MPEG, and P*64 standards. Such techniques are often used when storing graphics/video data on disks or when transmitting graphics/video data between computers. However, few designers have considered the effects of transferring large volumes of uncompressed graphics/video data between a CPU and a video subsystem in a PC or workstation.

Typically, the video subsystem will receive decompressed graphics/video data from the CPU, store the data in a frame buffer, and then transmit the graphics/video data to a RAMDAC for conversion into analog form to control the operation of the monitor. Thereafter, the video subsystem must generate a "refresh" data stream at a fixed rate to re-draw every pixel of the image displayed on the monitor. Refresh operations must be performed at a rate high enough to eliminate image flicker on the monitor. Currently, most monitors require that refresh operations be performed at a rate of 72 Hz or higher.

For high resolution and/or high color depth monitors, such refresh operations involve the transfer of huge amounts of uncompressed data. Moreover, the demands of the refresh operation at high resolution (e.g., greater than 1024×768 pixels), high color depth (e.g., greater than 32,000 colors), and high refresh rate (e.g., greater than 70 Hz) on a frame buffer is significant. For example, a monitor capable of displaying 1024×768 pixels using 256 colors and having a refresh rate of 72 Hz would require the transfer of 56.6 million bytes of uncompressed data every second for the refresh operations. A monitor capable of displaying 1280×1024 pixels using 16 million colors and having a refresh rate of 72 Hz refresh rate would require the transfer of 283.1 million bytes of uncompressed data every second for the refresh operations. Thus, refresh operations can consume a large percentage of the available bandwidth of the frame buffer, e.g., greater than 50%. However, refresh operations cannot be ignored or given a low priority, since failure to perform the refresh operations produces immediately perceptible visual artifacts on the monitor.

Trends in video subsystem design are also increasing the demand for sharing frame buffer ownership between multiple masters, for example, the CPU, a local graphics accelerator, and one or more video controllers. All of these devices compete for bandwidth of the frame buffer, and thus cause scheduling and performance problems. This is true even when the frame buffer is constructed as a double buffer, since the address, control, and data paths are commonly shared between devices. The access contention for the frame buffer and the collisions arising therefrom have a direct effect on graphics/video performance.

One common method of reducing collisions is to increase the amount of memory within each device. The device then signals a priority requirement for control of the frame buffer before its internal memory is fully depleted. If more memory can be used within the device, then it will less frequently require access to the frame buffer. Consequently, there would be greater latitude in scheduling requests for the frame buffer among various devices, thereby resulting in more efficient utilization of idle times.

An additional factor is the miss/hit ratio associated with the operation of the frame buffer. Current memory organizations often require that a miss cycle be performed to open a page of memory in the frame buffer. The miss cycle requires significantly longer access delay (3× or 4×) than a corresponding hit cycle. When multiple devices access the frame buffer, they often access different regions of memory and therefore generate a higher number of new page accesses resulting in a higher number of miss cycles. In addition, when inadequate buffer levels exist, there is a corresponding increase in the number of miss cycles. Any increase in miss cycles will decrease the total available bandwidth from the frame buffer.

Refresh operations have the additional constraint that the data must be output to the monitor in analog form. This is usually through some form of RAMDAC. The RAMDAC receives the pixel data in predefined bit widths (pixel port width) at a fixed frequency (pixel clock), and then translates the data through color palette RAMs that drive a set of DACs to convert the digital signals to the appropriate analog color levels. As resolution, color depth and refresh rates increase, the demands on the interface between the frame buffer and the RAMDAC become significant.

The impact of these factors is often translated into a wide pixel port operating at high frequency. For example, to operate a monitor capable of displaying 1280×1024 pixels using 16 million colors and having a refresh rate of 72 Hz refresh rate would require a 48 bit wide data path interface between a frame buffer and a RAMDAC operating at 65 MHz, or alternatively, a 24 bit data path interface between a frame buffer and a RAMDAC operating at 130 MHz. If address, control, and power pins are factored in, the interface may require between 50 and 100 package pins on an ASIC operating at between 65 MHz and 130 MHz.

All of these issues make the refresh operation an attractive candidate for performance enhancing design techniques. Moreover, the overhead incurred in refresh operations will undoubtably become more significant as resolution, color depth, and refresh rates continue to increase. Thus, there is a need in the art to reduce the impact of refresh operations, which in turn, would produce lower device costs and improved system performances.

SUMMARY OF THE INVENTION

To overcome the limitations in the prior art described above, and to overcome other limitations that will become apparent upon reading and understanding the present specification, the present invention discloses a method and apparatus for performing data compression during monitor refresh operations. In one embodiment, it is envisioned that the compression functions would be performed in a refresh compaction device and the de-compression functions would be performed in a RAMDAC, thereby requiring only the transfer of compressed data between the refresh compaction device and the RAMDAC. In an alternative embodiment, it is envisioned that both the compression and the de-compression functions would be performed in the refresh compaction device. Regardless of implementation, a "critical fill" level is determined during compression and a "critical fill" interrupt is generated during de-compression to gain control of the frame buffer before the compressed digital data is fully depleted from the refresh buffer.

One object of the present invention is introduce the benefits of data compression into monitor refresh operations of video subsystems for PCs and workstations. Another object of the present invention is to reduce the overhead incurred during monitor refresh operations of video subsystems. Still another object of the present invention is to permit higher resolution, increased color depth, and more frequent refresh rates for monitors without increasing the demands on frame buffers. Yet another object of the present invention is increase the available bandwidth of shared frame buffers, without ignoring refresh operations or giving such operations a low priority. Yet another object of the present invention is to permit the sharing of frame buffers among more devices without reducing the available bandwidth while preventing or minimizing contention for the frame buffers. Yet another object of the present invention is to eliminate the need for faster and wider RAMDACs for display monitors while increasing the amount of data being processed by the RAMDACs. Yet another object of the present invention is to permit higher resolution, increased color depth, and more frequent refresh rates for monitors without increasing the packaging requirements for ASICs. These and other objects will become more apparent upon the reading and understanding of the present specification.

BRIEF DESCRIPTION OF THE DRAWINGS

Referring now to the drawings in which like reference numbers represent corresponding parts throughout.

DETAILED DESCRIPTION OF THE PREFERRED EMBODIMENT

In the following description of the preferred embodiment, reference is made to the accompanying drawings which form a part hereof, and in which is shown by way of illustration a specific embodiment in which the invention may be practiced. It is to be understood that other embodiments may be utilized and structural changes may be made without departing from the scope of the present invention.

OVERVIEW

Figure 1:
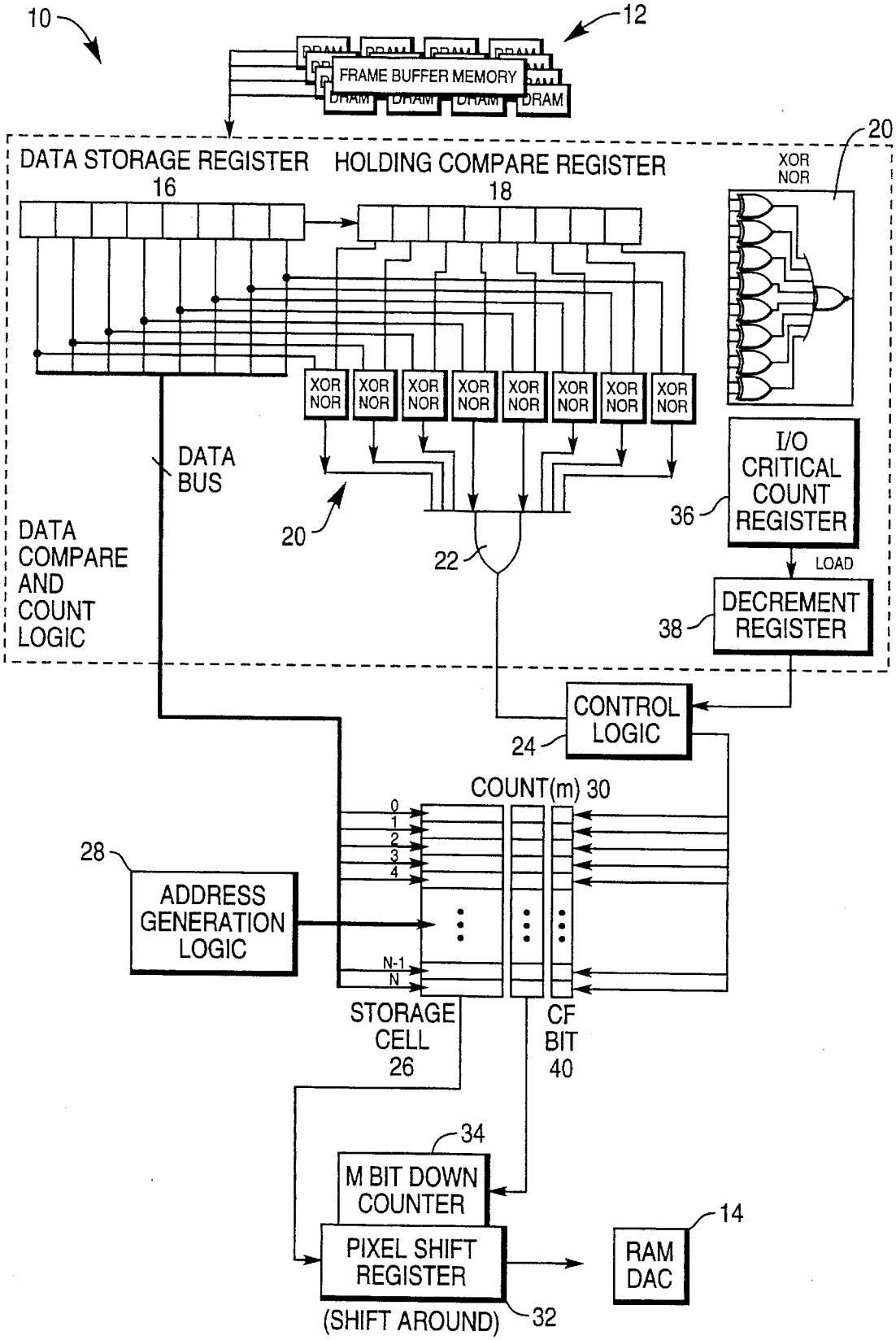
FIG. 1 is a block diagram illustrating an exemplary method and apparatus for performing data compression during refresh operations according to the present invention.

FIG. 1 is a block diagram illustrating an exemplary method and apparatus for performing data compression during refresh operations according to the present invention. The refresh compaction device 10 is placed in the data path between a frame buffer 12 and a RAMDAC 14. In one embodiment, it is envisioned that the compression functions would be performed in the refresh compaction device 10 and the de-compression functions would be performed in the RAMDAC 14, thereby requiring only the transfer of compressed data between the refresh compaction device 10 and the RAMDAC 14. In an alternative embodiment, it is envisioned that both the compression and the de-compression functions would be performed in the refresh compaction device 10. Those skilled in the art will recognize that other alternative embodiments could also be used to accomplish the objects of the present invention. Moreover, the present application is intended to describe the general functions of the invention without mandating that any function be located in a particular device. In addition, regardless of implementation, a "critical fill" level is determined during compression and a "critical fill" interrupt is generated during de-compression to gain control of the frame buffer 12 before the compressed digital data is fully depleted from the refresh compaction device 10.

The frame buffer 12 stores data for the monitor in the form of frame buffer 12 lines that typically comprise a plurality of pixels representing by bytes or words or other groupings of bits. One aspect of the present invention is the ability to perform data compression on frame buffer 12 lines at the frame buffer 12 line rate. It can be shown that data can be compressed using the logic of FIG. 1 within the line cycle time of the frame buffer 12. This is a function of the logic stages required, which in the preferred embodiment comprises three stages. As a result, data can be processed through the logic with less than 5 nanoseconds of transmission delay in a 0.8 micron ASIC. Of course, the delay would be even less with 0.5 micron or 0.35 micron ASIC.

In the present invention, a line from the frame buffer 12 is read and stored into a Data Storage Register (DSR) 16. At initialization, and whenever the contents of the frame buffer 12 line stored into the DSR 16 changes, the frame buffer 12 line is also stored in a Holding Compare Register (HCR) 18. A plurality of XOR/NOR blocks 20 are provided to compare each pixel stored in the HCR 18 to the corresponding pixel stored in the DSR 16. The results of these tests are combined by AND gate 22 and input into control logic 24.

The refresh compaction device 10 also comprises a refresh buffer comprised of a plurality of storage cells 26, which storage cells 26 are addressed by address generation logic 28. Each of the storage cells 26 is large enough to store one frame buffer 12 line from the DSR 16. Associated with each storage cell 26 is a Count(m) register 30 to record the number of sequential frame buffer 12 lines having identical contents (i.e., run-length coding). Upon readout, each storage cell 26 is selected in turn, and its contents are stored in a pixel shift register 32. The contents of the associated Count(m) register 30 are stored in an m-bit down counter 34. Thereafter, the contents of the pixel shift register 32 are shifted out multiple times, according to the m-bit down counter 34, to provide the correct number of identical frame buffer 12 lines in the correct sequence. Although the shift register 32 and the m-bit down counter 34 are shown outside the RAMDAC 14, it is envisioned that these components could be incorporated into the RAMDAC 14, as mentioned above.

Because the refresh compaction device 10 shares the bandwidth of the frame buffer 12 with other devices, it must signal a priority requirement for control of the frame buffer 12 before the storage cells 26 are fully depleted by a drain operation. This occurs when a "critical fill" level is reached during the drain operation, i.e., if the drain operation reaches a particular storage cell 26, then the fill operation needs to be set to a "critical" state. The critical fill level is programmable and its value is stored in a critical count register 36. Those skilled in the art will recognize that several different methods may be used to signal the critical fill event.

In the preferred embodiment, the fill operation loads the critical fill count from the critical count register 36 into a Decrement register 38, and decrements the Decrement register 38 for every frame buffer 12 line. When the Decrement register 38 decrements to 0, a Critical Fill (CF) bit 40 at the currently addressed storage cell 26 is set to signal the critical fill condition and the address generation logic 28 increments to the next storage cell 26 to continue the fill operation. Of course, the CF bit 40 could be set when the Count(m) register 30 has a value of 0, or 1, or any value up to 15. Regardless of when the CF bit 40 is set, there are no further accumulation of Count(m) register 30 values for that storage cell (e.g., the remaining values for the Count(m) register 30 go unused). In this way, the critical fill condition occurs as soon as the marked line is reached in the drain operation. This reduces the overall storage capacity of the refresh compaction device 10, but has the positive effect of being very simple to implement. Those skilled in the art will recognize that there are number of ways to implement the CF bit 40 marking without departing from the scope of the present invention.

During drain operations, the critical fill count is again loaded from the critical count register 36 into a Decrement register 38, which is decremented for every frame buffer 12 line read from the storage cells 26 and transmitted to the RAMDAC 14. When the Decrement register 38 decrements to 0, the CF bit 40 at the currently addressed storage cell 26 is examined. If the CF bit 40 is set, then the refresh compaction device 10 signals a priority interrupt for control of the frame buffer 12.

FILL OPERATION

Figure 2:
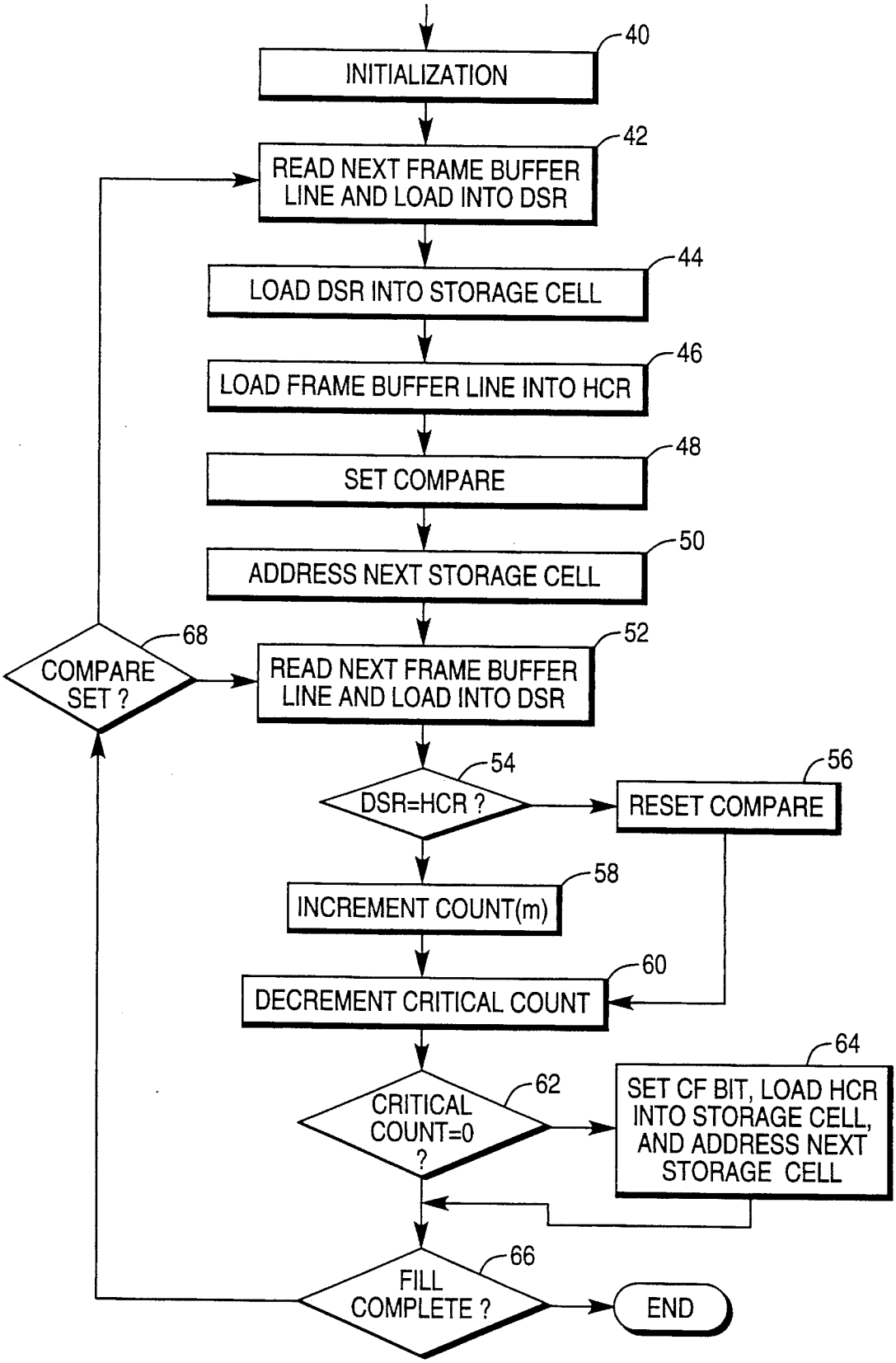
FIG. 2 is a flowchart describing the fill operation performed by the present invention.

FIG. 2 is a flowchart describing the fill operation performed by the present invention. The fill operation is initiated by a critical fill request or a normal fill request.

Block 40 represents an initial state wherein all Count(m) registers 30 are set to zero, all storage cells 26 contain invalid or unknown data, the address generation logic 28 is set to the first storage cell 26, the critical fill count is loaded from the critical count register 36 into the Decrement register 38, all CF bits 40 are reset, and the marking (i.e., setting) of CF bits 40 is enabled. Block 42 reads the next (e.g., first) frame buffer 12 line into the DSR 16. Block 44 loads the contents of the DSR 16 into the first storage cell 26 and increments the associated Count(m) register 30. Block 46 loads the contents of the DSR 16 into the HCR 18. Block 48 sets a Compare flag (not shown) in the control logic 24. Block 50 increments the address generation logic 28 to the next storage cell 26. Block 52 reads the next frame buffer 12 line into the DSR 16. Block 54 is a decision block that determines whether the DSR 16 and HCR 18 contain the same frame buffer 12 lines. If not, block 56 resets the Compare flag; otherwise, block 58 increments the Count(m) register 30 for the storage cell 26 containing the frame buffer 12 line. From either block 56 or 58, control transfers to block 60, which decrements the critical fill count in the Decrement register 38. Block 62 is a decision block that determines whether the Decrement register 38 is equal to zero. If so, control transfers to block 64, which sets the CF bit 40 for the current storage cell 26 containing the frame buffer 12 line, loads the contents of the HCR 18 into the next storage cell 26, and increments the address generation logic 28 to the following storage cell 26. Control then transfers to block 64, which is a decision block that determines whether the fill operation is complete. If so, the process terminates; otherwise, control transfers to block 68. Block 68 is a decision block that determines whether the Compare flag is set, which signifies that the current contents of the DSR 16 and HCR 18 are identical. If not, control transfers to block 42; otherwise, control transfers to block 52.

Those skilled in the art will recognize that there are many alternative methods may be used in performing the fill operation and that the present invention is not restricted to the particular method illustrated above.

DRAIN OPERATION

Figure 3:
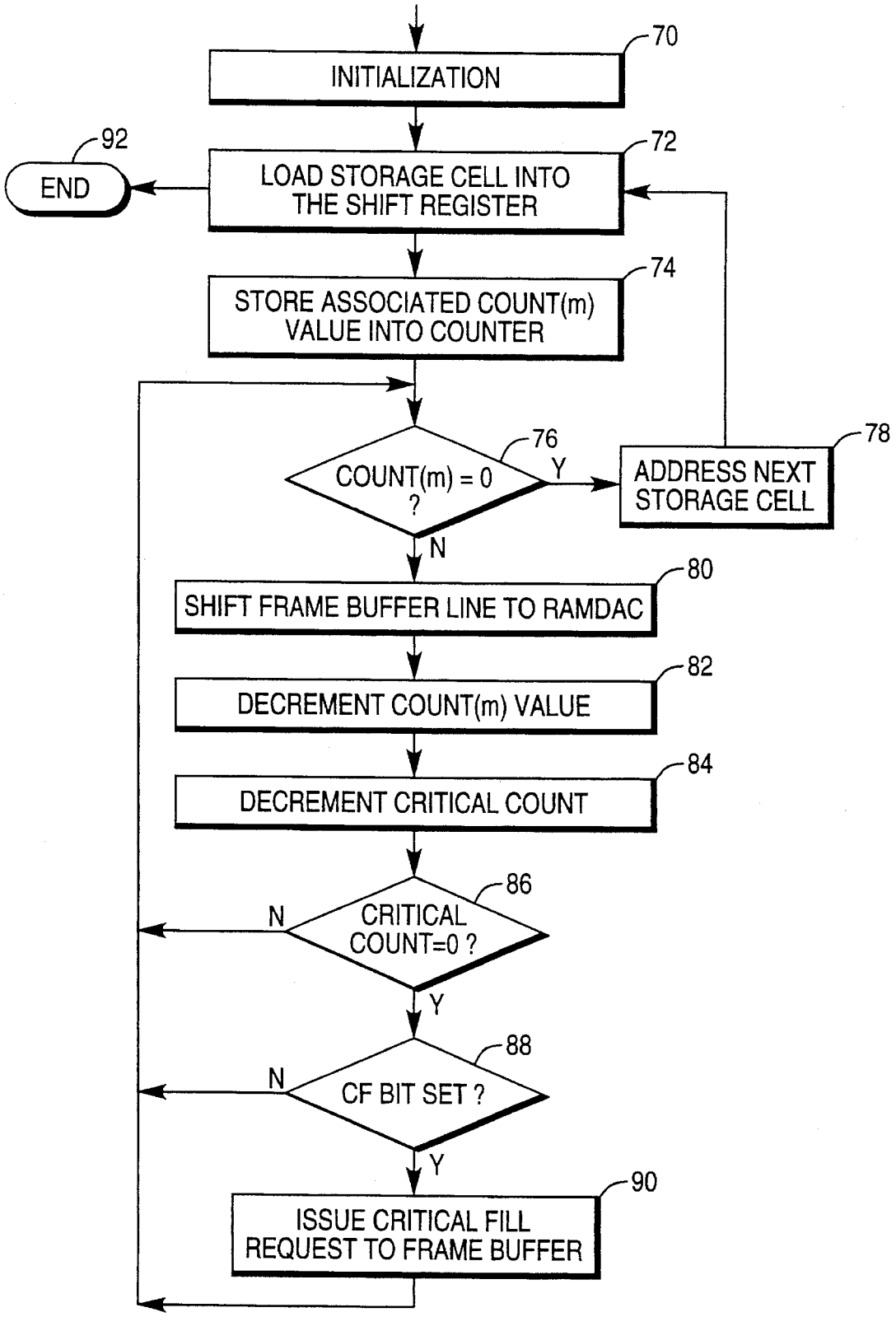
FIG. 3 is a flowchart describing the drain operation performed by the present invention.

FIG. 3 is a flowchart describing the drain operation performed by the present invention. The drain operation is initiated by an idle RAMDAC 14 condition or a normal drain request from the RAMDAC 14.

Block 70 represents an initial state wherein the address generation logic 28 is set to the first storage cell 26 and the critical fill count is loaded from the critical count register 36 into the Decrement register 38. Block 72 loads the contents of the currently addressed storage cell 26 into the shift register 32. Block 74 stores the contents of the associated Count(m) register 30 into the m-bit down counter 34. Block 76 is a decision block that determines whether the m-bit down counter 34 has been decremented to 0. If so, block 78 increments the current storage cell 26 address to the next storage cell 26 and transfers control to block 72; otherwise, block 80 shifts the frame buffer 12 line out of the shift register 32 to the RAMDAC 14, block 82 decrements the m-bit down counter 34, and block 84 decrements the critical fill count in the Decrement register 38. Block 86 is a decision block that determines whether the critical fill count has been decremented to 0. If not, control transfers to block 76; otherwise, control transfers to block 88. Block 88 is a decision block that determines whether the CF bit 40 is set for the currently addressed storage cell 26. If so, control transfers to block 90, which issues a critical fill request to the frame buffer 12 and then transfers control to block 76. Once all storage cells 26 have been drained to the RAMDAC, block 92 terminates the process.

Those skilled in the art will recognize that there are many alternative methods may be used in performing the drain operation and that the present invention is not restricted to the particular method illustrated above.

DUAL REFRESH BUFFERS

Figure 4:
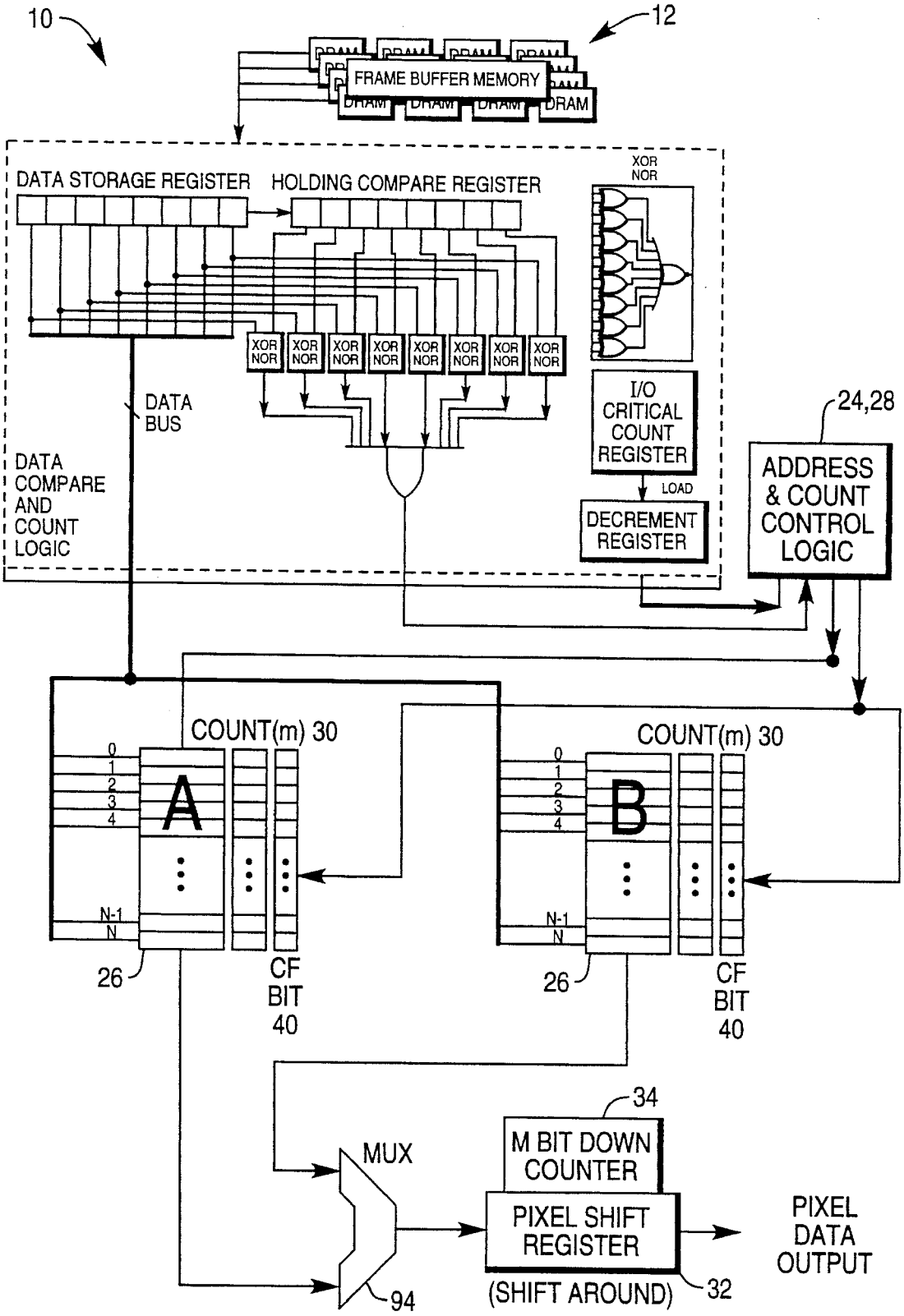
FIG. 4 is a block diagram illustrating a second exemplary method and apparatus for performing data compression during refresh operations according to the present invention.

FIG. 4 is a block diagram illustrating a second exemplary method and apparatus for performing data compression during refresh operations according to the present invention. FIG. 4 contains all the components of FIG. 1, except that it uses two sets of storage cells 26 labelled as "A" and "B," as well as additional logic in 24 and 28 to control the "ping pong" operation of the two sets of storage cells 26. FIG. 4 is also different from FIG. 1 in that it includes a multiplexor 94 to select the correct set of storage cells 26 for the drain operation. Using the structure of FIG. 4, the fill and drain operations can occur simultaneously, as well as at different rates according to the bandwidth of the frame buffer 12 and RAMDAC 14.

CONCLUSION

In summary, the present invention discloses a method and apparatus for performing data compression during monitor refresh operations. In one embodiment, it is envisioned that the compression functions would be performed in a refresh buffer and the de-compression functions would be performed in a RAMDAC, thereby requiring only the transfer of compressed data between the refresh buffer and the RAMDAC. In an alternative embodiment, it is envisioned that both the compression and the de-compression functions would be performed in the refresh buffer. Regardless of implementation, a "critical fill" level is determined during compression and a "critical fill" interrupt is generated during de-compression to gain control of the frame buffer before the compressed digital data is fully depleted.

The foregoing description of the preferred embodiment of the present invention has been presented only for the purposes of illustration and description. The foregoing description is not intended to be exhaustive or to limit the invention to the precise form disclosed. Many modifications and variations are possible in light of the teaching herein. For example, the following paragraphs describe some alternatives in accomplishing the same invention.

Those skilled in the art will recognize that the present invention is applicable to any device that has a memory and is not limited to refresh operations, or frame buffers, or refresh buffers, or RAMDACs. The application cited in the present specification is for illustrative purposes only and is not intended to be exhaustive or to limit the invention to the precise form disclosed.

Those skilled in the art will also recognize that the present invention is applicable to systems with different configurations of devices and components. The example configurations of devices and components cited in the present specification are for illustrative purposes only and are not intended to be exhaustive or to limit the invention to the precise form disclosed. For example, it may be advantageous to completely eliminate de-compression functions in the CPU, so that compressed data stored on disks can be directly sent to the refresh buffer or RAMDAC for de-compression.

In conclusion, it is intended that the scope of the invention be limited not by this detailed description, but rather by the claims appended hereto.

What is claimed is:

1. A video subsystem for a computer, comprising:

(a) a frame buffer for storing digital data to be displayed on a monitor, wherein the frame buffer is directly accessed by a plurality of devices;

(b) a refresh compaction device, coupled to the frame buffer, for retrieving the digital data from the frame buffer, for compressing the retrieved digital data, and for storing the compressed digital data for later retrieval, the refresh compaction device further comprising means for signalling a priority requirement for control of the frame buffer to exclude access by all other devices when the compressed digital data is being retrieved therefrom and before the refresh compaction device is fully depleted of the compressed digital data; and (c) means, coupled to the refresh compaction device, for retrieving the compressed digital data from the refresh compaction device, for de-compressing the compressed digital data, and for converting the de-compressed digital data into analog signals to control the monitor.

2. The invention as set forth in claim 1 above, wherein the refresh compaction device further comprises means for compressing the digital data at a line rate of the frame buffer.

3. The invention as set forth in claim 1 above, wherein the means for signalling comprises means for determining when an amount of the compressed digital data stored in the refresh compaction device has dropped to a critical fill level.

4. The invention as set forth in claim 1 above, wherein the means for signalling comprises means for determining when an amount of the compressed digital data retrieved from the refresh compaction device has reached a critical fill level.

5. The invention as set forth in claim 1 above, wherein the refresh compaction device further comprises an internal buffer comprised of a plurality of memory locations having a storage cell portion and a counter portion, and means for storing the digital data in the storage cell portions and means for recording a run-length coding of the digital data in the counter portions.

6. The invention as set forth in claim 5 above, further comprising means for accumulating the run-length coding for the compressed digital data retrieved from the refresh compaction device, for comparing the accumulated run-length coding with a predetermined critical fill level, and for signalling a priority requirement for control of the frame buffer when the accumulated run-length coding matches the pre-determined critical fill level.

7. The invention as set forth in claim 5 above, wherein the means for retrieving comprises means for retrieving the compressed digital data from the storage cell portion, means for retrieving the run-length coding from the counter portion, means for de-compressing the compressed digital data by generating a repetitive stream of the digital data as indicated by the run-length coding, and means for converting the repetitive stream of the digital data into analog signals to control the monitor.

8. A video subsystem for a computer, comprising:

(a) a frame buffer for storing digital data to be displayed on a monitor, wherein the frame buffer is directly accessed plurality of devices;

(b) a digital-to-analog converter for converting the digital data into analog signals to control the monitor; and (c) a refresh compaction device, coupled to both the frame buffer and the digital-to-analog converter, for retrieving the digital data from the frame buffer, for compressing the digital data, for storing the compressed digital data in an internal buffer, for retrieving the compressed digital data from the internal buffer, for de-compressing the compressed digital data, and for transmitting the digital data to the digital-to-analog converter, wherein the refresh compaction device further comprises means for signalling a priority requirement for control of the frame buffer to exclude access by all other devices when the compressed digital data is being retrieved therefrom and before the refresh compaction device is fully depleted of the compressed digital data.

9. A data compression method for video subsystem of a computer, comprising the steps of:

(a) storing digital data in a frame buffer, wherein the frame buffer is directly accessed by a plurality of devices;

(b) retrieving the digital data from the frame buffer, compressing the digital data, and storing the compressed digital data in a refresh compaction device;

(c) retrieving the compressed digital data from the refresh compaction device, de-compressing the compressed digital data in a digital-to-analog converter, and converting the de-compressed digital data into analog signals to control the monitor using the digital-to-analog converter; and (d) signalling a priority requirement for control of the frame buffer to exclude access by all other devices when the compressed digital data is being retrieved from the refresh compaction device and before the refresh compaction device is fully depleted of the compressed digital data.

10. The invention as set forth in claim 9 above, wherein the signalling step comprises the step of determining when an amount of the compressed digital data stored in the refresh compaction device has dropped to a critical fill level.

11. The invention as set forth in claim 9 above, wherein the signalling step comprises the step of determining when an amount of the compressed digital data retrieved by the digital-to-analog converter has reached a critical fill level.

12. The invention as set forth in claim 9 above, wherein the refresh compaction device comprises an internal buffer comprised of a plurality of memory locations having a storage cell portion and a counter portion, and the retrieving step (b) further comprises the steps of storing the digital data in the storage cell portions and recording a run-length coding of the digital data in the counter portions.

13. The invention as set forth in claim 12 above, further comprising the steps of accumulating the run-length coding for the compressed digital data retrieved by the digital-to-analog converter, comparing the accumulated run-length coding with a predetermined critical fill level, and signalling a priority requirement for control of the frame buffer when the accumulated run-length coding matches the pre-determined critical fill level.

14. The invention as set forth in claim 12 above, wherein the retrieving step (c) comprises the steps of retrieving the compressed digital data from the storage cell portion, retrieving the run-length coding from the counter portion, de-compressing the compressed digital data by generating a repetitive stream of the digital data as indicated by the run-length coding, and converting the repetitive stream of the digital data into analog signals to control the monitor.

15. A data compression method for video subsystem of a computer, comprising the steps of:

(a) storing digital data to be displayed on a monitor in a frame buffer, wherein the frame buffer is directly accessed by a plurality of devices;

(b) retrieving the digital data from the frame buffer, compressing the digital data in a refresh compaction device, storing the compressed digital data in the refresh compaction device, retrieving the compressed digital data from the refresh compaction device, de-compressing the compressed digital data in the fresh buffer, and transmitting the digital data to a digital-to-analog converter;

(c) converting the digital data into analog signals to control the monitor using the digital-to-analog converter; and (d) signalling a priority requirement for control of the frame buffer to exclude access by all other devices when the compressed digital data is being retrieved from the refresh compaction device and before the refresh compaction device is fully depleted of the compressed digital data.

* * * * *